US007014303B2

(12) United States Patent
Matsushita et al.

(10) Patent No.: US 7,014,303 B2
(45) Date of Patent: Mar. 21, 2006

(54) INKJET PRINTER

(75) Inventors: Masaki Matsushita, Nara (JP); Hirokazu Nakamura, Nara (JP); Naozumi Ueno, Ikoma (JP); Hisashi Yoshimura, Nara (JP); Takashi Goto, Nara (JP); Hiroshi Ishii, Osaki (JP)

(73) Assignee: Sharp Kabushiki Kaisha, Osaka (JP)

( * ) Notice: Subject to any disclaimer, the term of this patent is extended or adjusted under 35 U.S.C. 154(b) by 147 days.

(21) Appl. No.: 10/728,865

(22) Filed: Dec. 8, 2003

(65) Prior Publication Data

US 2004/0114011 A1 Jun. 17, 2004

(30) Foreign Application Priority Data

Dec. 9, 2002 (JP) ..... 2002-356985

(51) Int. Cl.
*B41J 2/175* (2006.01)
*B41J 2/19* (2006.01)

(52) U.S. Cl. ..... 347/85; 347/92

(58) Field of Classification Search ..... 347/85, 347/86, 87, 92, 93
See application file for complete search history.

(56) References Cited

U.S. PATENT DOCUMENTS 4,149,172 A * 4/1979 Heinzl et al. ..... 347/92
4,368,478 A * 1/1983 Koto ..... 347/86
4,586,058 A * 4/1986 Yamazaki et al. ..... 347/92
5,485,187 A * 1/1996 Okamura et al. ..... 347/85
5,777,649 A * 7/1998 Otsuka et al. ..... 347/94
5,943,078 A * 8/1999 Nishimoto et al. ..... 347/89
6,007,193 A * 12/1999 Kashimura et al. ..... 347/92
6,158,855 A * 12/2000 Saikawa ..... 347/93
6,481,837 B1 * 11/2002 Askren et al. ..... 347/85

FOREIGN PATENT DOCUMENTS

JP 05-131645 5/1993
JP 2002-036557 2/2002

* cited by examiner

*Primary Examiner*—Anh T.N. Vo
(74) *Attorney, Agent, or Firm*—Birch, Stewart, Kolasch & Birch, LLP

(57) ABSTRACT

The invention offers an inkjet printer which does not produce defective prints when bubbles enter ink supply tube. There is provided an air trap in an ink supply tube near an ink delivery port of an ink tank. The air trap is a hollow rectangular parallelepiped with a flow passage length of Lx, a height of Lh as measured from the bottom of an ink flow to a highest part, and a width of W. On its downstream end, the air trap has an outlet having a height of Ly as measured from the bottom of an ink flow. The air trap has a bubble catching space above the outlet. The dimensions are determined so that bubbles float at least up to height Ly while passing through the flow passage of length Lx. When bubbles flow into the air trap, they float and are caught in the space of the air trap before reaching the outlet.

13 Claims, 4 Drawing Sheets

INKJET PRINTER

CROSS-REFERENCE TO RELATED APPLICATION

This Nonprovisional application claims priority under 35 U.S.C. § 119(a) on Patent Application No. 2002/356985 filed in Japan on Dec. 9, 2002, the entire contents of which are hereby incorporated by reference.

FIELD OF THE INVENTION

The present invention relates to inkjet printers equipped with an ink tank containing ink for use and an supply tube.

BACKGROUND OF THE INVENTION

An inkjet printer is a printing machine which prints by ejecting ink onto a sheet, and has an ink head from which ink is ejected and an ink cartridge. The ink cartridge is mounted to an upper part of the print head to store an ink supply to the print head. There is an ink cartridge which has: an ink tank provided with an ink absorber made of a porous material to hold ink; and an ink supply tube through which ink is supplied from the ink tank to the print head. The ink supply tube is attached to the ink tank with an end reaching inside the tank.

The conventional structure has defective print problems caused by bubbles which enter a passage connecting the place where the tube is attached to the print head, that is, inside the ink supply tube, in attaching the tube.

The problems are addressed in, for example, Japanese published unexamined patent application 5-131645 (Tokukaihei 5-131645/1993; published on May 28, 1993). The disclosure shows a print head having a filter tank where ink experiences turbulent flows and slipstream to destroy bubbles in it and goes through a filter before being fed to the print head.

Another example is Japanese published unexamined patent application 2002-36557 (Tokukai 2002-36557; published on Feb. 5, 2002). The disclosure shows a cartridge capable of preventing bubbles from interrupting ink supply by rendering the buoyancy of the bubbles inside the ink supply chamber greater than the drag force caused by high ink velocity so as to prevent bubbles from growing in an ink supply chamber.

However, the approach disclosed in the patent application 5-131645 still has defective print problems: bubbles may attach to and clog the filter, thereby obstructing ink flow. Bubbles can enter the ink head unless the mesh of the filter is substantially small.

The approach taken in the patent application 2002-36557 has defective print problems too. The approach is not able to remove bubbles from inside the ink supply tube once they are trapped in it.

SUMMARY OF THE INVENTION

Conceived to solve the conventional problems, the present invention provides an inkjet printer which does not produce defective prints when bubbles enter the ink supply tube.

An inkjet printer in accordance with the present invention is characterized in that it includes:

an ink tank storing ink; and an ink supply tube supplying the ink from the ink tank to a print head, wherein the ink supply tube is provided with a bubble catching section for catching bubbles in the ink.

According to the invention, the bubble catching section catches bubbles flowing in the ink, preventing them from reaching the print head.

Thus, the invention offers an inkjet printer which does not produce defective prints when bubbles enter the ink supply tube.

Additional advantages and novel features of the invention will be set forth in part in the description which follows, and in part will become apparent to those skilled in the art upon examination of the following or may be learned by practice of the invention.

BRIEF DESCRIPTION OF THE DRAWINGS

FIG. 1(*b*) shows a cross section taken along line A-A in FIG. 1(*a*).

DESCRIPTION OF THE INVENTION

Figure 1:
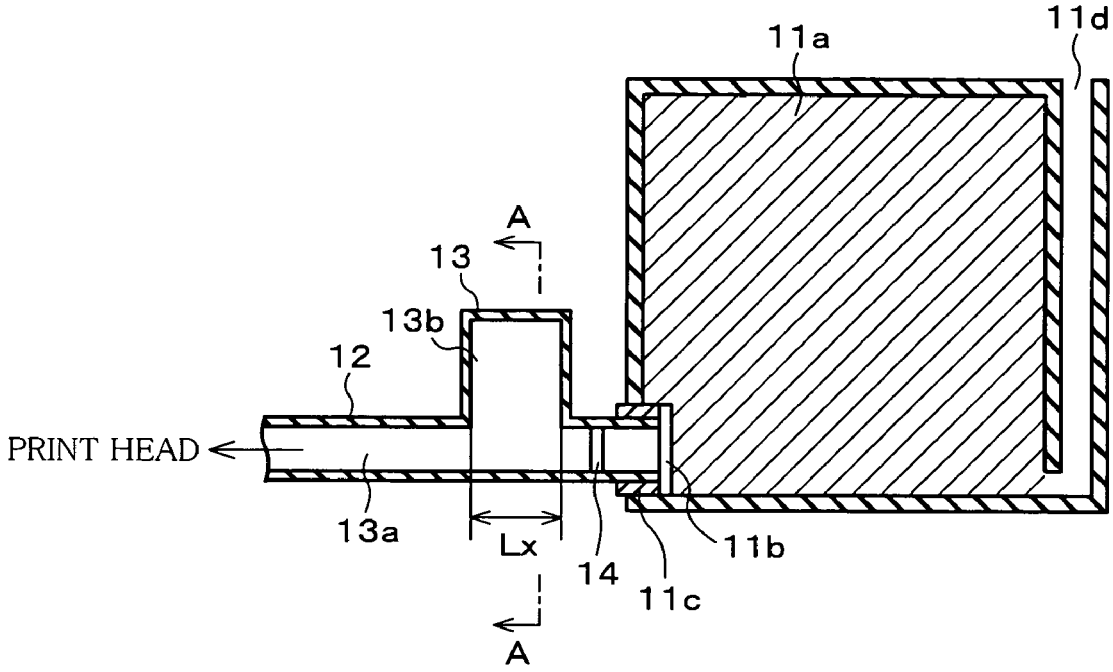
FIG. 1(*a*) is a cross-sectional view showing a structure of an ink tank and its surroundings provided in an inkjet printer which is an embodiment of the present invention.
Figure 1:
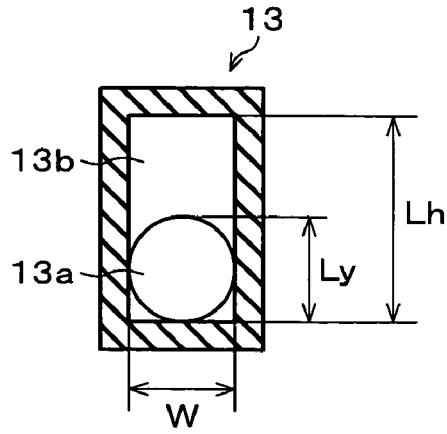
Figure 4:
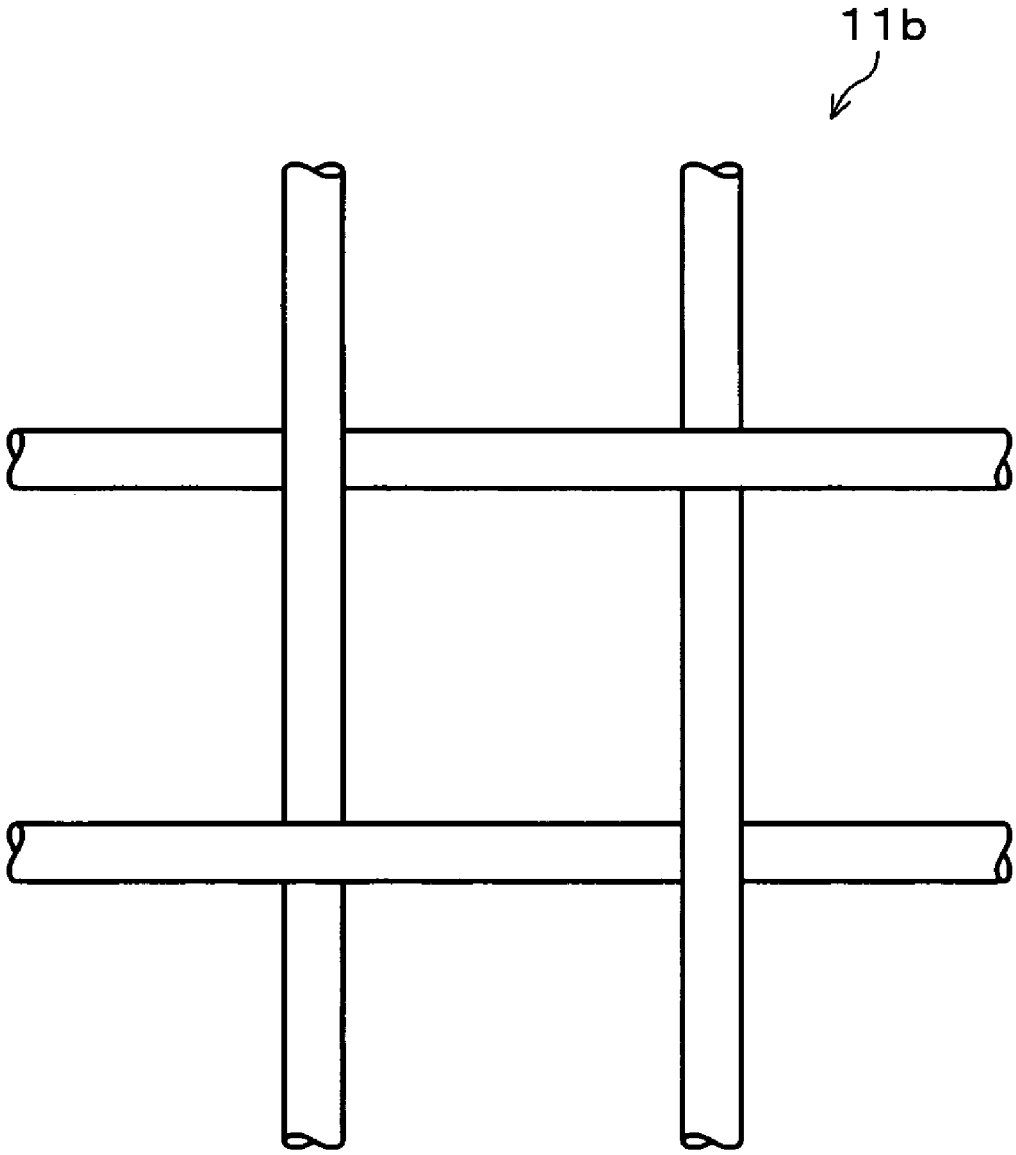
FIG. 4 is a plan view showing the structure of a mesh filter.

The following will describe an embodiment of the present invention with reference to FIG. 1(*a*) through FIG. 4.

Figure 3:
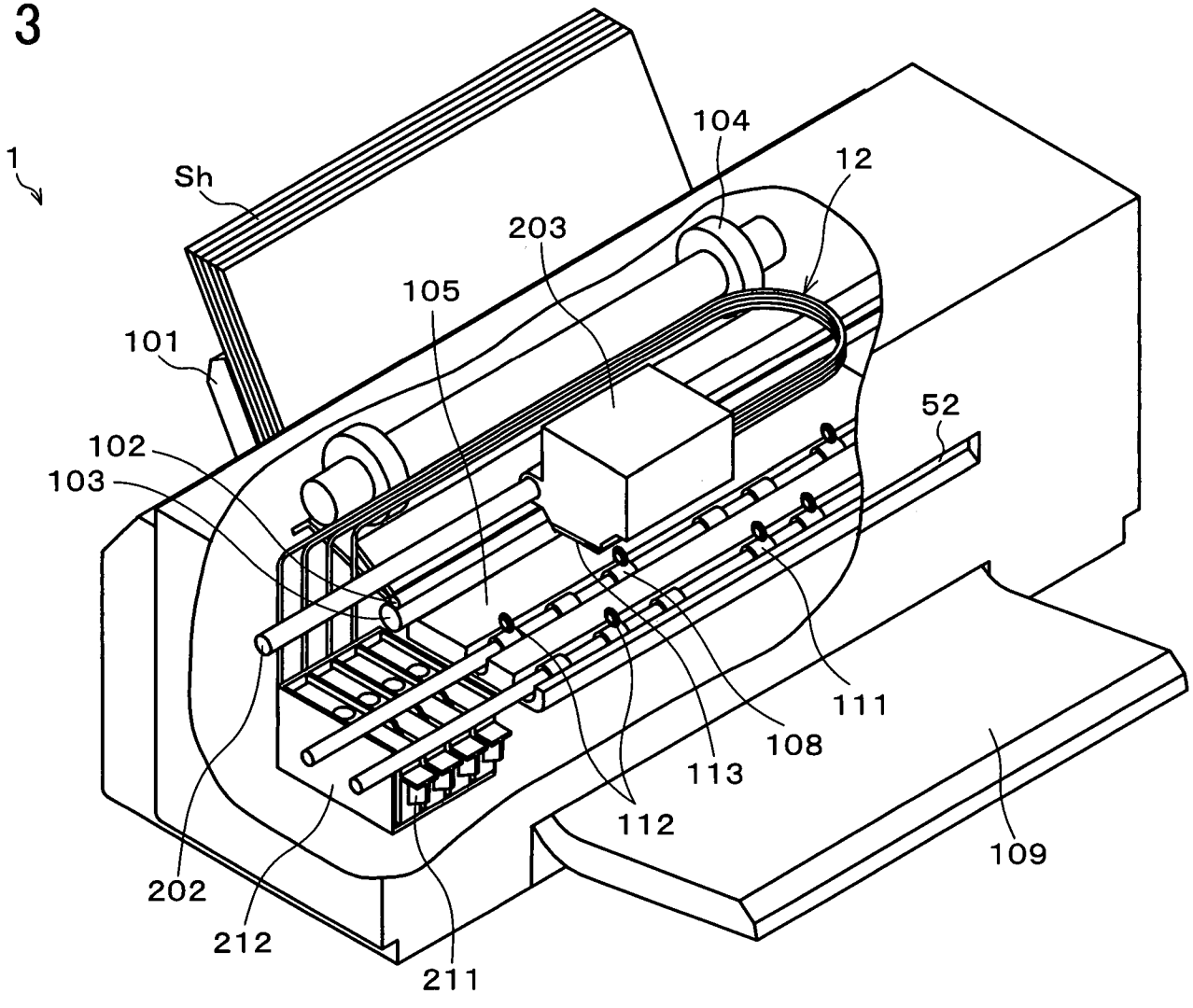
FIG. 3 is a perspective view showing the structure of an inkjet printer which is an embodiment of the present invention.

FIG. 3 shows the structure of an inkjet printer 1 which is the present embodiment. The inkjet printer 1 is made up of a feeder unit, a separator unit, a transport unit, a print unit, and an ejector unit.

The feeder unit supplies paper (recording paper) SH for printing and is made up of a paper feed tray 101 and a pickup roller 104. When the printer is not in operation, the feeder unit serves to hold the paper SH.

The separator unit is for supplying the paper SH sent from the feeder unit to the print unit a sheet at a time. The separator unit is made up of a paper feed roller (not shown in the figure) and a separator (not shown in the figure). The separator is adapted to generate greater friction between a pad (where the separator contacts the paper) and the paper SH than between sheets of paper SH, and to generate greater friction between the paper feed roller and the paper SH than between the pad and the paper SH and between sheets of paper SH. Hence, when two sheets SH are transported to the separator unit, the paper feed roller separates the sheets SH so that only the one on top can be fed to the transport unit.

The transport unit transports, to the print unit, the paper SH fed sheet by sheet from the separator unit, and is made up of a guide board (not shown in the figure) and a pair of rollers (a transport/pressure roller 102 and a transport roller 103). The pair of rollers is a member adjusting the transport of the paper SH so that when the paper SH is inserted between a print head 113 and a platen 105, the print head 113 can spray ink at a suitable position on the paper SH.

The print unit prints on the paper SH fed from the pair of rollers of the transport unit. The print unit is made up of the print head 113, a carriage 203 carrying the print head 113, a carriage hold shaft 202 acting as a guide shaft for the carriage 203, an ink cartridge 211 supplying ink to the print head 113 via the ink supply tube 12, an ink cartridge receptacle 212 to which the ink cartridge 211 is attached, and the platen 105 providing a support table when printing on the paper SH.

The ejector unit discharges the paper SH after printing from the inkjet printer 1, and is made up of discharge rollers 108, 111, a stir wheel 112 provided opposite to the discharge rollers 108, 111, a paper discharge opening 52, and a discharge tray 109.

The inkjet printer 1 thus structured prints in the following manner.

First, for example, a computer (not shown in the figure) sends a print request to the inkjet printer 1 based on image information. Upon receipt of the print request, the inkjet printer 1 moves a sheet of paper SH on the paper feed tray 101 from the feeder unit using the pickup roller 104. The paper SH is then passed through the separator unit and moved on to the transport unit by the paper feed roller. In the transport unit, the pair of rollers inserts the paper SH between the print head 113 and the platen 105.

Next, in the print unit, the print head 113 sprays ink through its eject nozzle onto the paper SH on the platen 105 according to the image information. During the spraying, the paper SH temporarily stops on the platen 105. While the head 113 is spraying ink, the carriage 203 scans a line in a main scan direction as guided by the carriage hold shaft 202. After that, the paper SH is moved on the platen 105 in an auxiliary scan direction by a predetermined distance. The print unit repeats the process detailed above according to the image information, to print the whole image on the paper SH.

The printed paper SH is passed through an ink drier and discharged onto the discharge tray 109 through the paper discharge opening 52 by the discharge rollers 108, 111. Thereafter, the paper SH is given to the user as printed material.

Now, the ink cartridge 211 used in the present embodiment will be described with reference to FIGS. 1(*a*), 1(*b*), and 2.

Figure 2:
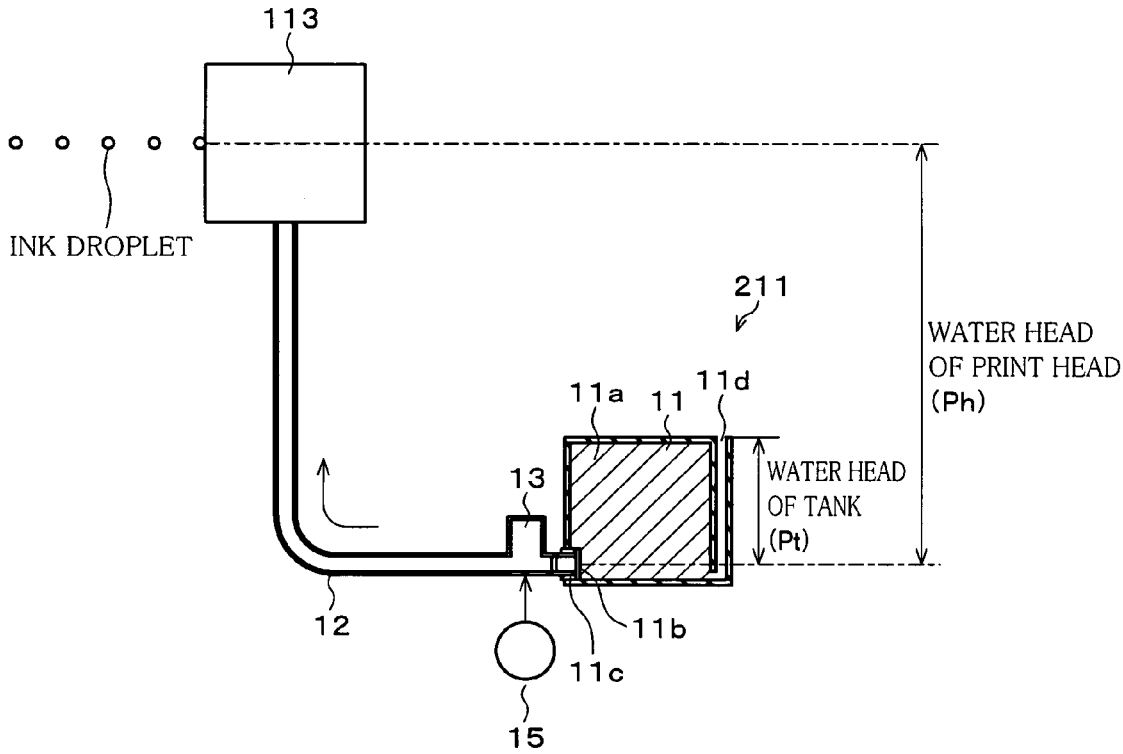
FIG. 2 is a cross-sectional view showing how the ink tank is connected to the print head.

Referring to FIG. 2, the ink cartridge 211 is made primarily of an ink tank 11 having an empty space to store ink and the ink supply tube 12 supplying ink from the ink tank 11 to the print head 113.

Inside the ink tank 11 is there provided an ink absorber 11*a* made of, for example, a polyurethane. The absorber 11*a* is porous and capable of holding ink. The ink supply tube 12 supplying ink to the print head 113 is connected to the ink tank 11 with an end of the tube 12 inserted inside through an ink delivery port 11*c* near the bottom of the tank 11. A filter 11*b* is installed at the interface between the ink absorber 11*a* and the ink supply tube 12. The ink tank 11 has a through hole 11*d* providing ambient air a passage to the ink absorber 11*a*. The ink supply tube 12 has an air trap (bubble catching section) 13 near the ink delivery port 11*c*.

The water head, Pt, of the tank is lower than the water head, Ph, of the print head so that the ink in the ink tank 11 can be sucked out via the print head 113. The print head 113 delivers the ink in the form of droplets as illustrated in the figure.

FIG. 1(*a*) is an enlarged view showing the ink tank 11 and its periphery in FIG. 2. FIG. 1(*b*) is a cross-sectional view taken along line A—A in FIG. 1(*a*).

The air trap 13 is a hollow rectangular parallelepiped. It has a flow passage length of Lx, a height of Lh as measured from the bottom of the ink flow to a highest part, and an internal width of W measured at right angles to the flow passage. The air trap 13 is equipped with an outlet 13*a* on its downstream end. The outlet 13*a* has a height of Ly as measured from the bottom of the ink flow. The outlet 13*a* connects to the downstream ink supply tube 12 and its height Ly is equal to the internal diameter of the ink supply tube 12 other than the air trap 13 as measured in a height direction. The air trap 13 has a bubble catching space 13*b* above the outlet 13*a*. The space 13*b* encompasses the entire space between Ly and Lh.

Between the ink delivery port 11*c* of the ink tank 11 and the air trap 13 is there provided a valve 14 which opens/closes the flow passage through the ink supply tube 12.

Suppose that bubbles are flowing in the ink supply tube 12 from the upstream end of the air trap 13. Recall that the air trap 13 has the space 13*b* above the outlet 13*a*. The air trap 13 therefore has a greater cross section perpendicular to the flow passage direction than the part of the flow passage immediately before the air trap 13. Bubble flow slows down where the ink flow passage has an enlarged cross section. Thus, the buble flow across the flow passage length Lx of the air trap 13 is slower than that in the flow passage immediately before the air trap 13. A result is that the bubbles take longer to travel the flow passage length Lx (time tx). Under these conditions, the bubbles can move up higher than the height Ly of the outlet 13*a* of the air trap 13 and collect in the space 13*b* of the air trap 13 within the traveling time tx if the buoyancy of the bubbles are greater than the drag force exerted perpendicularly on bubbles.

The air trap 13 exploits this phenomenon: bubbles float into the space 13*b* where they are caught before reaching the outlet 13*a*. Thus, the bubbles are readily caught. Also, the air trap 13 catch bubbles accidentally introduced to the ink supply tube 12 when, for example, attaching the ink tank 11, thereby preventing the bubbles from flowing out to the print head 113 and causing defective printing.

The buoyancy Ru (N) of a bubble is given by $$Ru=\rho\cdot g(\pi/6)\cdot d^3$$

where ρ is the ink density (kg/m$^3$), g is the gravitational acceleration (m/s$^2$), and d is the diameter (m) of the bubble. The drag force Rf (N) experienced by a bubble is given by:

$$Rf=Cd\cdot S_v\cdot\rho\cdot V^2/2$$

where Cd is the drag coefficient, $S_v$ is the cross-sectional area (m$^2$) of the bubble, V is the velocity (m/s) of the bubble. The Reynolds number is given by $$Re=V\cdot d/\nu$$

where Re is the Reynolds number, and ν is the dynamic viscosity (m$^2$/s) of the ink. When Re<10, the expression is approximated using Stokes's equation:

$$Cd\approx 24/Re$$

When the bubble's buoyancy becomes equal to the drag force exerted on it (buoyancy=drag force), the vertical velocity V of the bubble settles at the ultimate value Vy (m/s) satisfying the following expression:

$$\rho\cdot g\cdot(\pi/6)\cdot d^3=\{24/(Vy\cdot d/\nu)\}\cdot((\pi/4)\cdot d^2))\cdot\rho\cdot Vy^2/2$$

where Vy is the velocity at which the bubble moves upwards (upward bubble velocity).

Rearranging the foregoing expressions, the upward bubble velocity Vy is given by:

$$Vy=(1/18)\cdot g\cdot d^2/\nu$$

Define $$tx=Lx/Vx$$

$$Ly/tx=(Ly/Lx)\cdot Vx$$

where tx is the traveling time (s), Lx is the flow passage length (m), Vx is the ink flow velocity (m/s), and Ly is the outlet height (m)).

$$Vx=Q/S_T$$

where Q is the average flow of ink per unit time ($m^3/s$), ST is the cross-sectional area ($m^2$) of the flow passage in the air trap 13.

Therefore, the bubble is caught in the air trap 13 if the buoyancy of the bubble grows greater than the drag force on the bubble, and $Vy \geqq Ly/tx$.

Therefore, the conditions under which the bubble is caught is given by the following expression:

$$(1/18)\cdot g\cdot d^2/\nu \geqq (Ly/Lx)\cdot(Q/S_T) \quad (1)$$

If the expression holds, bubbles rise above the height Ly of the outlet 13*a* of the air trap 13, so that the bubbles are certainly caught in the space 13*b*.

Especially preferred conditions are such that bubbles can reach the ceiling of the space 13*b* within tx. Under these conditions, it is preferred if expression (1) holds with Ly being replaced with Lh. When this is the case, bubbles do not drawn back to the ink flow. Bubbles are readily caught and hardly released.

As mentioned previously, the ink delivery port 11*c* of the ink tank 11 is equipped with the filter 11*b* which breaks the bubbles flowing out of the ink tank 11 toward the ink supply tube 12 into smaller bubbles. The bubbles are broken because their internal pressure exceeds a threshold value determined by the surface tension of the ink and the mesh size of the filter 11*b*. Therefore, the broken bubbles have a diameter substantially equal to the mesh size of the filter 11*b*. The mesh size is measured across a diameter if the mesh of the filter 11*b* is circular or a diagonal if the mesh is square. Supposing that the mesh size of the filter 11*b* is C (m), bubbles having passed through the filter 11*b* are caught in the air trap 13 if expression (1) holds with C substituted for d.

$$(1/18)\cdot g\cdot C^2/\nu \geqq (Ly/Lx)\cdot(Q/S_T) \quad (2)$$

Again in expression (2), Ly is preferably replaced with Lh.

Alternatively, the filter 11*b* may be a mesh filter shown in FIG. 4. A mesh filter is fabricated by forming an intertwined net of, for example, a stainless material. Assuming the filter precision of the mesh filter to M (m), the effective mesh of the mesh filter is $2^{1/2}$ times the filter precision ($2^{1/2}\cdot M$). Substituting $2^{1/2}\cdot M$ for d in expression (1), we obtain $$(1/18)\cdot g\cdot(2^{1/2}\cdot M)^2/\nu \geqq (Ly/Lx)\cdot(Q/S_T) \quad (3)$$

When expression (3) holds, the air trap 13 can certainly catch the bubbles. Again in expression (3), Ly is preferably replaced with Lh.

Also, the provision of the valve 14 enables discharge of bubbles from the air trap 13. To do this, the valve 14 is closed, and a vacuum pump (not shown in the figure) is used to reduce the internal pressure of the ink supply tube 12. The internal pressure of the ink supply tube 12 can be measured with a pressure gauge 15 as illustrated in FIG. 2. Subsequent to bubble discharge, opening the valve 14 opens the ink flow passage and creates a flow with no bubbles caught in the air trap 13.

To solve the problems, it is also preferred if the inkjet printer in accordance with the present invention is arranged for the bubble catching section to have a space above the outlet on its downstream end so that the bubbles flowing in the ink float and are caught in the space before reaching the outlet.

According to the arrangement, the bubble catching section has a space above the outlet where bubbles are caught; the bubble catching section has a greater cross-sectional area perpendicular to the flow passage direction than the part of the flow passage immediately before the bubble catching section. Bubble flow is therefore slower in the bubble catching section than in the part of the flow passage immediately before the bubble catching section. This enables the bubble catching section to float and catch the bubbles in the space before they reach the outlet. Thus, the bubbles are readily caught.

To solve the problems, it is also preferred if the inkjet printer in accordance with the present invention satisfies the expression:

$$(1/18)\cdot g\cdot d^2/\nu \geqq (Ly/Lx)\cdot(Q/S_T)$$

where g is the gravitational acceleration ($m/s^2$), d is the diameter (m) of the bubbles, ν is the dynamic viscosity ($m^2/s$) of the ink, Lx is the length (m) of the flow passage in the bubble catching section, Ly is the height (m) of the outlet from the bottom of the ink flow, Q is an average ink flow per unit time ($m^3/s$), and $S_T$ is the cross-sectional area ($m^2$) of the flow passage in the bubble catching section.

According to the arrangement, the inkjet printer satisfies the expression: therefore, when bubbles are flowing in the bubble catching section, the buoyancy of the bubbles is greater in the vertical direction than the drag force on the bubbles. Bubbles rise to a height in excess of the height Ly of the outlet before they travel the flow passage length Lx and collect in the upper space.

Thus, the bubble catching section is capable of reliably catching bubbles.

To solve the problems, it is also preferred if the inkjet printer in accordance with the present invention satisfies the expression:

$$(1/18)\cdot g\cdot d^2/\nu \geqq (Lh/Lx)\cdot(Q/S_T)$$

where Lh is the height (m) of the highest part of the space from the bottom of the ink flow.

According to the arrangement, when bubbles are flowing in the bubble catching section, bubbles collect in the highest part of the space above before traveling the flow passage length Lx. Bubbles are easily caught and hardly released.

To solve the problems, it is also preferred if the inkjet printer in accordance with the present invention is equipped with a filter at an ink delivery port of the ink tank interfacing the ink supply tube and satisfies the expression:

$$(1/18)\cdot g\cdot C^2/\nu \geqq (Ly/Lx)\cdot(Q/S_T)$$

where g is the gravitational acceleration ($m/s^2$), C is the mesh size (m) of the filter, ν is the dynamic viscosity ($m^2/s$) of the ink, Lx is the length (m) of the flow passage in the bubble catching section, Ly is the height (m) of the outlet from the bottom of the ink flow, Q is an average ink flow per unit time ($m^3/s$), and $S_T$ is the cross-sectional area ($m^2$) of the flow passage in the bubble catching section.

According to the arrangement, a filter is provided at the ink delivery port of the ink tank interfacing the ink supply tube. The bubbles flowing out of the ink tank into the ink supply tube are broken by the filter. The bubbles are broken because their internal pressure exceeds a threshold value determined by the surface tension of the ink and the mesh size of the filter. Therefore, the broken bubbles have a diameter substantially equal to the mesh size of the filter. The mesh size is measured across a diameter if the mesh of the filter is circular or a diagonal if the mesh is square; The expression being satisfied, the bubble catching section is capable of reliably catching the bubbles.

To solve the problems, it is also preferred if the inkjet printer in accordance with the present invention satisfies the expression:

$$(1/18)\cdot g\cdot C^2/\nu \geqq (Lh/Lx)\cdot(Q/S_T)$$

where Lh is the height (m) of the highest part of the space from the bottom of the ink flow.

According to the arrangement, when bubbles are flowing in the bubble catching section, bubbles collect in the highest part of the space above before traveling the flow passage length Lx. Bubbles are easily caught and hardly released.

To solve the problems, it is also preferred if the inkjet printer in accordance with the present invention is equipped with a mesh filter at an ink delivery port of the ink tank interfacing the ink supply tube and satisfies the expression:

$$(1/18)\cdot g\cdot(2^{1/2}\cdot M)^2/\nu \geqq (Ly/Lx)\cdot(Q/S_T)$$

where g is the gravitational acceleration ($m/s^2$), M is the filter precision (m) of the mesh filter, ν is the dynamic viscosity ($m^2/s$) of the ink, Lx is the length (m) of the flow passage in the bubble catching section, Ly is the height (m) of the outlet from the bottom of the ink flow, Q is an average ink flow per unit time ($m^3/s$), and $S_T$ is the cross-sectional area ($m^2$) of the flow passage in the bubble catching section.

According to the arrangement, a mesh filter is provided which has an effective mesh $2^{1/2}$ times the filter precision. The expression being satisfied, the bubble catching section is capable of reliably catching the bubbles.

To solve the problems, it is also preferred if the inkjet printer in accordance with the present invention satisfies the expression:

$$(1/18)\cdot g\cdot(2^{1/2}\cdot M)^2/\nu \geqq (Lh/Lx)\cdot(Q/S_T)$$

where Lh is the height (m) of the highest part of the space from the bottom of the ink flow.

According to the arrangement, when bubbles are flowing in the bubble catching section, bubbles collect in the highest part of the space above before traveling the flow passage length Lx. Bubbles are easily caught and hardly released.

To solve the problems, it is also preferred if the inkjet printer in accordance with the present invention has a valve between the ink tank and the bubble catching section to open/close the flow passage.

According to the arrangement, the bubbles in the bubble catching section are discharged by closing the valve to reduce pressure downstream to the valve. After the bubble discharge, the valve is opened to open the ink flow passage and create a flow with no bubbles caught in the bubble catching section.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed:

1. An inkjet printer, comprising:

a print head;

an ink tank storing ink;

an ink supply tube having an upstream and a downstream portion supplying the ink from the ink tank to said print head, a filter at said upstream portion directing ink through said supply tube from said ink tank for breaking bubbles present in said ink into smaller bubbles; and a bubble catching section in said downstream portion, downstream of said filter and upstream of said print head for catching said smaller bubbles.

2. The inkjet printer as set forth in claim 1, wherein the bubble catching section has a space extending upwards from the ink supply tube so that the bubbles float and are caught in the space before the ink is supplied to the print head via the ink supply tube.

3. The inkjet printer as set forth in claim 1, wherein the bubble catching section has a space above a downstream outlet so that the bubbles float and are caught in the space before the bubbles reach the outlet.

4. The inkjet printer as set forth in claim 3, wherein $$(1/18)\cdot g\cdot d^2/\nu \geqq (Ly/Lx)\cdot(Q/S_T)$$

where g is a gravitational acceleration ($m/s^2$), d is a diameter (m) of the bubbles, ν is a dynamic viscosity ($m^2/s$) of the ink, Lx is a length (m) of a flow passage in the bubble catching section, Ly is a height (m) of the outlet from a bottom of the flowing ink, Q is an average ink flow per unit time ($m^3/s$), and $S_T$ is a cross-sectional area ($m^2$) of the flow passage.

5. The inkjet printer as set forth in claim 4, wherein $$(1/18)\cdot g\cdot d^2/\nu \geqq (Lh/Lx)\cdot(Q/S_T)$$

where Lh is a height (m) of a highest part of the space from the bottom.

6. The inkjet printer as set forth in claim 3, wherein:

the ink tank is provided with a filter at an ink delivery port thereof interfacing the ink supply tube; and $$(1/18)\cdot g\cdot C^2/\nu \geqq (Ly/Lx)\cdot(Q/S^T)$$

where g is a gravitational acceleration ($m/s^2$), C is a mesh size (m) of the filter, ν is a dynamic viscosity ($m^2/s$) of the ink, Lx is a length (m) of a flow passage in the bubble catching section, Ly is a height (m) of the outlet from a bottom of the flowing ink, Q is an average ink flow per unit time ($m^3/s$), and $S_T$ is a cross-sectional area ($m^2$) of the flow passage.

7. The inkjet printer as set forth in claim 6, wherein $$(1/18)\cdot g\cdot C^2/\nu \geqq (Lh/Lx)\cdot(Q/S_T)$$

where Lh is a height (m) of a highest part of the space from the bottom.

8. The inkjet printer as set forth in claim 3, wherein the ink tank is provided with a mesh filter at an ink delivery port thereof interfacing the ink supply tube; and $$(1/18)\cdot g\cdot(2^{1/2}\cdot M)^2/\nu \geqq (Ly/Lx)\cdot(Q/S_T)$$

where g is a gravitational acceleration ($m/s^2$), M is a filter precision (m) of the mesh filter, ν is a dynamic viscosity ($m^2/s$) of the ink, Lx is a length (m) of a flow passage in the bubble catching section, Ly is a height (m) of the outlet from a bottom of the flowing ink, Q is an average ink flow per unit time ($m^3/s$), and $S_T$ is a cross-sectional area ($m^2$) of the flow passage.

9. The inkjet printer as set forth in claim 8, wherein $$(1/18)\cdot g\cdot(2^{1/2}\cdot M)^2/\nu \geqq (Lh/Lx)\cdot(Q/S_T)$$

where Lh is a height (m) of a highest part of the space from the bottom.

10. The inkjet printer as set forth in claim 8, wherein the mesh filter is fabricated by intertwining a stainless material into a net.

11. The inkjet printer as set forth in claim 3, wherein the space in the bubble catching section extends from a height above the outlet up to an uppermost part of the bubble catching section.

12. The inkjet printer as set forth in claim 1, wherein there is provided a valve between the ink tank and the bubble catching section controlling the flow of ink in said ink supply tube.

13. The inkjet printer as set forth in claim 1, wherein there is provided a vacuum pump connected with said bubble catching section for discharging bubbles therefrom.

* * * * *